US007679051B2

(12) United States Patent
Burch

(10) Patent No.: US 7,679,051 B2
(45) Date of Patent: Mar. 16, 2010

(54) ION COMPOSITION ANALYZER WITH INCREASED DYNAMIC RANGE

(75) Inventor: James L. Burch, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 455 days.

(21) Appl. No.: 11/383,910

(22) Filed: May 17, 2006

(65) Prior Publication Data

US 2008/0061229 A1 Mar. 13, 2008

(51) Int. Cl.
*H01J 49/48* (2006.01)

(52) U.S. Cl. ..... 250/281; 250/296; 250/305

(58) Field of Classification Search ..... 250/281
See application file for complete search history.

(56) References Cited

U.S. PATENT DOCUMENTS 3,334,225 A * 8/1967 Langmuir ..... 250/292
4,435,642 A * 3/1984 Neugebauer et al. ..... 250/296
4,758,722 A * 7/1988 Leckey et al. ..... 250/305
5,168,158 A * 12/1992 McComas et al. ..... 250/287
5,365,064 A * 11/1994 Rettinghaus ..... 250/305
5,661,298 A * 8/1997 Bateman ..... 250/281
2004/0026614 A1 * 2/2004 Bateman et al. ..... 250/281

* cited by examiner

*Primary Examiner*—David A. Vanore
*Assistant Examiner*—Phillip A. Johnston
(74) *Attorney, Agent, or Firm*—Chowdhury & Georgakis PC

(57) ABSTRACT

A system and method for separating ions in an ion mixture, such as a plasma in space. The ion mixture enters an electrostatic analyzer, whose ion path has at least two sections. A first section applies a DC voltage to the ions, and a next section applies an RF frequency voltage to the ions. Appropriate DC and RF voltages are applied, such that at least a portion of the lower mass ions are absorbed into the RF section of the analyzer. The heaver ions are transmitted out of the ion path and are readily available for further analysis.

8 Claims, 3 Drawing Sheets

ION COMPOSITION ANALYZER WITH INCREASED DYNAMIC RANGE

TECHNICAL FIELD OF THE INVENTION

This invention relates to ion composition analysis, and more particularly to instruments designed for composition measurements of plasmas in space.

BACKGROUND OF THE INVENTION

The dynamic range of ion composition analysis instruments is limited by several factors. Two problems are saturation of particle counters and spillover of signals from highly dominant species into channels tuned to minor species.

Instruments designed for composition measurements of hot plasmas in space can suffer greatly from both of these problems because of the wide energy range required and the wide disparity in fluxes encountered in various regions of interest. To detect minor ions in regions of weak fluxes, geometry factors need to be as large as practicable. As a result, in dense plasma regions, problems with saturation by the dominant fluxes and spillover to minor-ion channels become especially acute.

Present-day ion composition instruments have been unable to provide meaningful measurement of minor ion species at the Earth's magnetopause (the boundary between the magnetosphere and the solar wind). This is due to high background levels caused by spillover of dominant proton fluxes. Specifically, this effect has precluded ion composition measurements at energies in the important keV range at the magnetopause.

Previous attempts to solve the dynamic-range problem have involved mechanical constrictions that reduce the throughput equally for all species. This approach alleviates the saturation and spillover problems, but reduces the minor ion throughput to levels that are often undetectable.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

As stated in the Background, hot plasmas resident in the magnetospheres of the Earth and other planets present a challenging target for space-borne particle detectors, and particularly for ion composition instruments. These plasmas have source regions both in the solar wind and in the planetary ionospheres, so there is typically a mixture of ions such as hydrogen, helium, oxygen, nitrogen, and other minor species with density ratios that are in some cases very high. The varying mass/charge ratios and fluxes present a difficult challenge in attempting ion composition analysis.

This description is directed to systems and methods for solving the dynamic range problem in the few-eV to several-keV energy/charge range. This energy/charge range is important for space physics research, where the dominant ions are of low mass/charge (typically H+), and the minor ions are of higher mass/charge (typically O+).

The technique described herein involves using radio-frequency (RF) modulation of a deflection electric field in an electrostatic analyzer used with a time-of-flight (TOF) instrument. The analyzer reduces H+ counts into the TOF instrument by a controllable amount of up to factors of 1000, while reducing O+ counts by a known and calibratable several percent.

Figure 1:
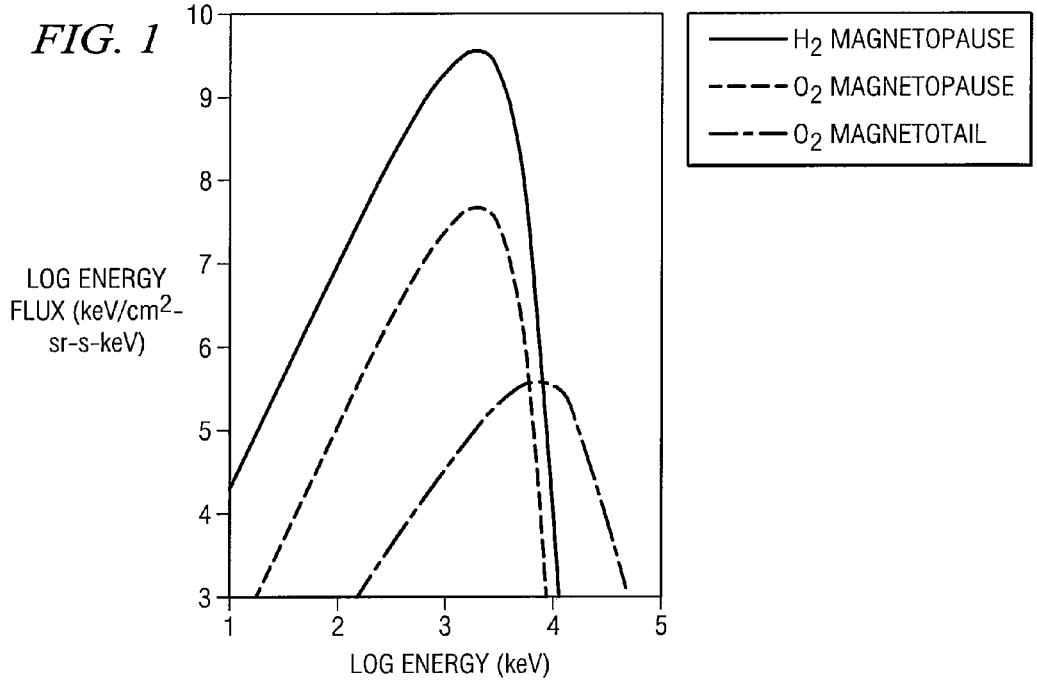
FIG. 1 illustrates representative ion fluxes encountered in a magnetopause region by a spacecraft.

FIG. 1 illustrates representative ion fluxes that will be encountered in the Earth's magnetosphere region by a particle analyzer in space. Typical applications of such particle analyzers are the ion composition instruments used on a spacecraft, such as a spacecraft used for NASA's magnetospheric multiscale (MMS) mission.

The H+ fluxes are representative of a compressed dayside boundary region (magnetopause) with density of 80 $cm^{-3}$ and 400 km/s bulk flow, similar to the high-speed flows observed in reconnection. The O+ fluxes are modeled after the beams observed in the Low Latitude Boundary Layer, which lies just outside the magnetopause. The magnetotail fluxes are modeled after plasma sheet encounters, including the O+ composition representative of disturbed magnetospheric conditions.

As shown in FIG. 1, the proton fluxes are often extremely high. In contrast, in the same part of the magnetosphere, important minor ions will have fluxes of only a few percent of the proton flux. Because of thermalization by the bow shocks, which slow the solar wind in front of the magnetospheres, and wave turbulence within the magnetospheres, the ion distribution function covers a wide energy range with significant flux at all entrance angles to a particle analyzer.

Two major problems limit the dynamic range of space-borne ion composition instruments (particle analyzers). The first is simply the requirement for very high counting rates, a requirement that results when an instrument that is sensitive enough to detect minor species in a tenuous plasma region must also measure major species in a more dense region. The second is the spillover from dense major species into channels tuned to minor species.

Figure 2:
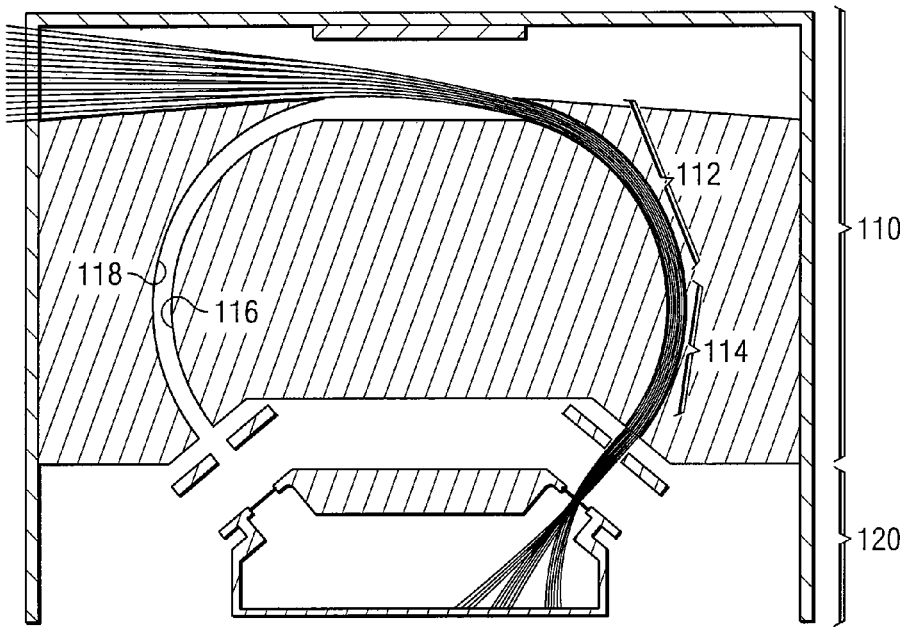
FIG. 2 illustrates a toroidal tophat electrostatic analyzer and a time-of-flight (TOF) mass analyzer in accordance with the invention.

FIG. 2 illustrates an ion composition analyzer 110, which provides improved dynamic range in accordance with the invention. Analyzer 110 is a "tophat" type electrostatic analyzer 110, and provides ions to the entrance of a time-of-flight (TOF) mass analyzer 120. Together, analyzer 110 and TOF analyzer 120 measure three-dimensional composition-resolved distribution functions of hot plasmas in space.

More specifically, FIG. 2 is a planar section view of a toroidal analyzer 110 with deflection plates 116 and 118 that create an ion path within the analyzer 110. The ion path is segmented into a DC entrance section 112 and an RF exit section 114. An example of a suitable deflection plate gap is 4.1 mm, constant throughout the analyzer 110.

In the example of FIG. 2, analyzer 110 has a curved-plate and toroidal configuration for the ion path. In other words, deflection plates 116 and 118 form a curved toroidal path. Other configurations may be used, such as the more common spherical tophat geometry, or such as various non-tophat geometries (cylindrical, hemispherical, etc.), or parallel plate geometries.

The technique involves the incorporation of a radio-frequency (RF) deflection voltage in the exit segment 114 of the analyzer 110. A DC deflection voltage is applied to the entrance segment 112 as a pre-filter to the RF section. The entrance section 112 applies the DC deflection electric field to the ions within, and presents a nearly monoenergetic beam ($\Delta E/E \sim 0.2$) to the exit section 114. The same DC deflection voltage is applied to the exit section 114, but an additional RF voltage is superimposed on it. Without the DC pre-filtering, the RF deflection section 114 would simply sample adjacent parts of the wide energy spectrum typically encountered in magnetospheric environments.

FIG. 2 further illustrates ray tracing of the ion paths through the analyzer 110. Appropriate software can be used to simulate ion paths through analyzer 110. An example of such software is the SimIon™ software, available from Scientific Instrument Services, Inc.

For purposes of example, the paths of H+ and O+ ions are shown. Analyzer 110 can reduce the H+ flux to extremely low levels while keeping the O+ flux nearly unaffected.

In the electrostatic analyzer 110, the RF deflection voltage causes only slight deflections of slower-moving heavy ions (such as oxygen), which execute several oscillations about the center line between the deflection plates as they transit the RF deflection section. These ions will tend to remain within the deflection plates during an RF period. Lighter, faster-moving ions (such as hydrogen) will strike the deflection plates in a time short compared to the RF period of the deflection voltage.

Thus, the analyzer 110 acts as a high-pass mass/charge filter (or equivalently, a low-pass velocity filter). By varying the frequency and magnitude of the RF deflection voltage, the filtering can cover a fairly wide range of energies and can be tuned to transmit known fractions of ions at all masses. In this way it solves both of the dynamic range problems (count saturation and major species spillover) mentioned above.

In the example of FIG. 2, a uniform mixture of H+ and O+ ions enters the "tophat" of the analyzer 110 from the left and is deflected into the entrance region 112 by the DC field. H+ and O+ ions at an energy/charge of 1 keV fill the field of view of the analyzer 110, which has a DC potential difference of 189 V across the deflection plates in the DC section.

The entrance section 112 of the ion path, with its DC field, is an "energy filter". All ions within a selected narrow energy band regardless of mass, are transmitted through this section 112 and enter the exit section 114. The DC potential is selected to choose the energy to be transmitted. In volts, the potential is typically about 15% or so of the energy in electron volts.

The ions then travel into the exit region 114 where RF is applied. In the RF section, a 5 MHz 150 V signal is added to the DC deflection potential. The applied voltage may vary. In the RF section, the O+ ions are transmitted by the analyzer 110 and enter the TOF analyzer 120. For the deflection voltage and RF frequency used, the H+ ions are seen to be totally absorbed by the plates 116 and 118, while the O+ ions exhibit a high transmission fraction.

In the exit section 114 of the ion path, the RF frequency is chosen so that a heavy ion will undergo many cycles of low-amplitude spatial oscillation as it traverses the deflection plates. Lighter ions will undergo a much smaller number of higher-amplitude oscillations along their paths. The result is a high transmission of heavy ions (e. g., O+) and a successively lower transmission as the ion mass decreases and the ions begin to strike the deflection plates.

By varying the RF frequency and voltage, ion filtering can be optimized for certain combinations of ions at various energies. For a fairly narrow energy range, such as that for H+ at the magnetopause, a single frequency RF deflection voltage is sufficient to allow accurate O+ measurements while reducing the H+ count rate to a known and manageable level.

The specific electrostatic analyzer 110 used is a variation on a conventional tophat analyzer. Instead of spherically symmetric deflection plates, the analyzer 110 has a toroidal geometry, which is somewhat more efficient by volume and has focusing characteristics that are better suited to coupling with a TOF mass-analyzer 120.

To illustrate the technique in mathematical terms, consider the effect of a peak RF voltage $V_0$ at frequency f applied across a deflection gap $\Delta y$ in a parallel-plate analyzer, in which the DC applied deflection voltage is zero. The deflection from the central plane of the analyzer as a function of time is given by:

$$y(t) = \int_0^t \left[ \int_0^\tau a(t)\,dt \right] d\tau = \int_0^t \left[ \int_0^\tau \frac{qV_0}{2m\Delta y} \cos(\omega t + \theta)\,dt \right] d\tau \tag{1}$$

$$= \frac{qV_0}{2m\Delta y} \left[ \frac{-\cos\theta + \omega t \sin\theta - \cos(\omega t + \theta)}{\omega^2} \right] \tag{2}$$

Because of the difference in velocity between light and heavy ions with the same energy/charge (E), it is more relevant to examine the dependence of the deflection (y) from the central plane of the analyzer on the distance down the segment of the analyzer that has the RF voltage applied. Because $v_x = \sqrt{2E/m}$ is constant, we can substitute $t = x/v_x$ in Equation (2).

Figure 3:
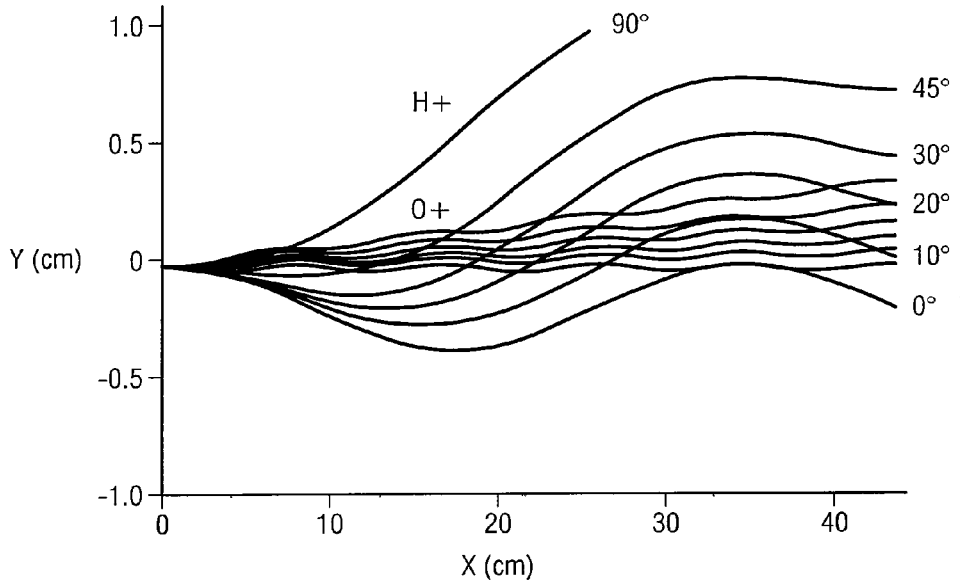
FIG. 3 illustrates how the path of ions through the analyzer depends on the phase of the RF deflection voltage, using the system of FIG. 2.

FIG. 3 illustrates plots of y as a function of distance (x) for H+ and O+ with equal energies/charge of 1 keV for the following selected analyzer parameters: $V_0$=150 V, $\Delta y$=4 mm, and $f = \omega/2\pi$=5 MHz. Phases of the RF voltage when the ions enter the analyzer 110 are noted on the $H^+$ curves.

As shown in FIG. 3, the path of the ions through the analyzer depends on the phase of the RF deflection voltage at t=0. This effect is illustrated for phase angles between 0° and 90°, the results of which are representative of the full range of angles. It is evident from FIG. 3, that for analyzer segments of a few cm in length, the H+ ions will be deflected into the plates while the O+ ions will not. Eventually, of course, the O+ ions will also strike the plates if they are too long.

Figure 4A:
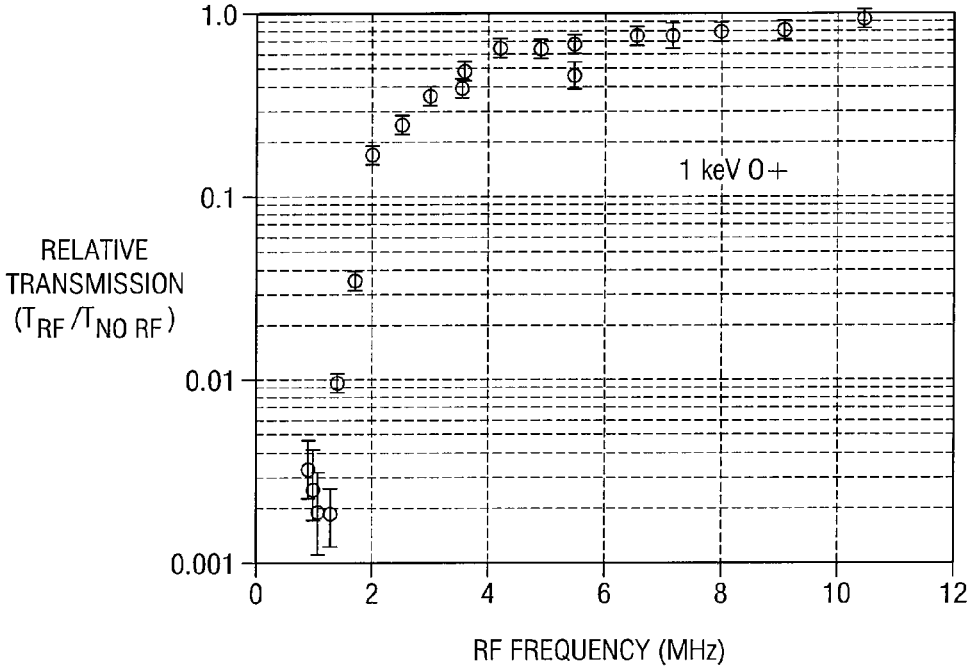
FIGS. 4A and 4B illustrate results of a laboratory test, with relative transmission of oxygen ions and protons as a function of applied RF frequency, using the system of FIG. 2.
Figure 4B:
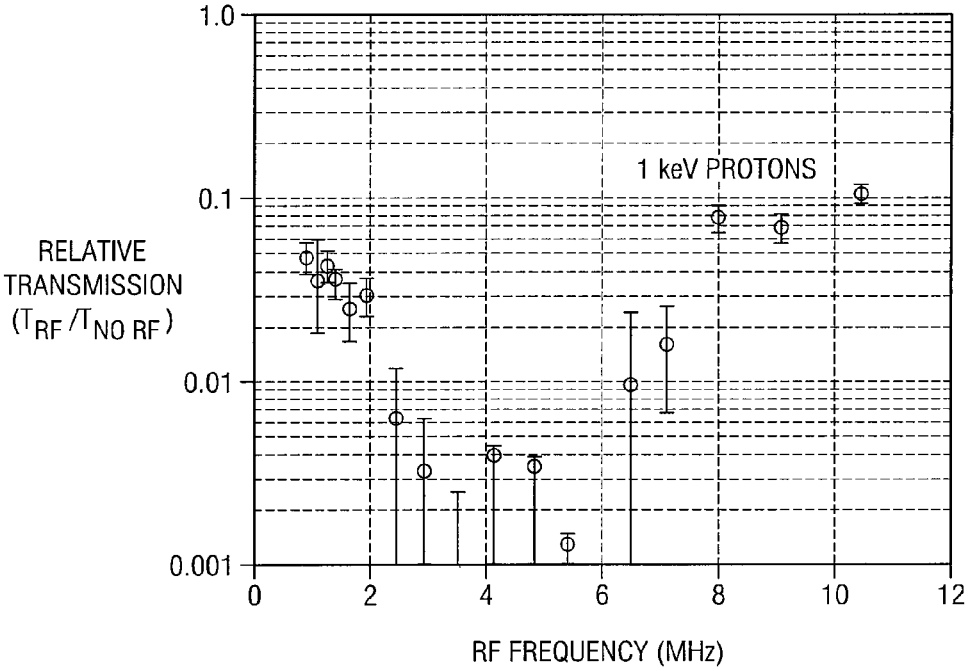

FIGS. 4A and 4B illustrate results of a laboratory test using the system of FIG. 2, with relative transmission of 1 keV singly-charged oxygen ions (FIG. 4A) and protons (FIG. 4B) as a function of applied RF frequency. The optimum response is seen to be at about 5 MHz. At this frequency, the proton counts are reduced by nearly three orders of magnitude while the O+ counts are reduced by only about 25% as compared to the response with a DC deflection voltage.

Figure 5:
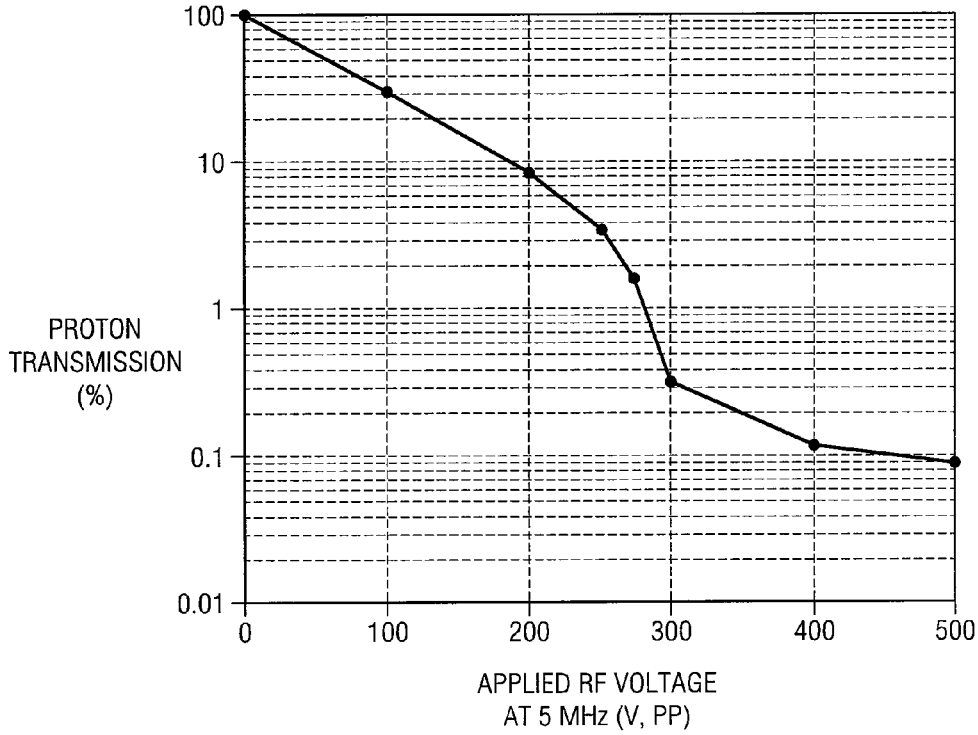
FIG. 5 illustrates results of a laboratory test, with the transmission ratio of protons as a function of the peak-to-peak voltage of the RF deflection potential, using the system of FIG. 2.

FIG. 5 illustrates results of another laboratory test using the system of FIG. 2, with the transmission ratio of 1 keV protons as a function of the peak-to-peak voltage of the 5 MHz deflection potential. A thousand-fold reduction in proton throughput is possible. The throughput can be regulated to intermediate values.

In sum, the above described system and method solves the problem of spillover of major ion signals in mass analyzers, which results in contamination of minor ion signals. It provides a controllable reduction of major ion throughput with little or no reduction in minor ion throughput.

The RF technique described herein can be tailored for effective use in many space and laboratory environments. The method will separate high mass ions from low mass ions regardless of flux differences, and is particularly useful when the light ions have significantly higher fluxes than the heavy ions of interest, a situation that would otherwise cause measurement problems. In space applications, the heavy ions of interest have lower fluxes than the lower mass ions, which favors application of the method herein.

The use of analyzer 110 with a TOF analyzer 120 is but one application of the invention. Analyzer 110 could be used without TOF analyzer, acting as a lower resolution mass spectrometer. Also, TOF analyzer 120 could be replaced by other types of mass analyzers, such as a magnetic sector mass analyzer.

What is claimed is:

1. A method of selectively reducing ion counts in an ion mixture in a plasma in space, wherein the mixture has at least a first ion type and a second ion type, the first ion type being lower in mass than the second ion type, the first ion type and the second ion type further comprising ions of an energy range, comprising:

receiving the ion mixture into an electrostatic analyzer;

wherein the electrostatic analyzer has a toroidal ion path between two deflection plates, the ion path having a first section for applying a DC voltage and a second section for applying an RF frequency voltage to the ions within the ion path;

wherein the toroidal ion path receives ions in a 360 degree range of input angles;

wherein the first and second sections are adjacent, such that ions enter the first section, pass directly from the first section to the second section and exit the second section;

applying a DC voltage across the plates of the first section, wherein the DC voltage has no AC component and is selected to permit only ions within a selected energy band of the energy range to pass from the first section to the second section; and applying an RF voltage across the plates of the second section, and selecting a length of the second section, such that a predominant number of ions of the first ion type undergo at least one oscillation between the plates and are absorbed into the deflection plates before exiting the second path and a predominant number of ions of the second ion type are allowed to exit the second path.

2. The method of claim 1, further comprising the step of receiving the transmitted ions into the entrance aperture of a time of flight analyzer that analyzes all mass species simultaneously.

3. The method of claim 1, wherein the analyzer substantially transmits oxygen ions.

4. The method of claim 1, wherein the analyzer substantially absorbs hydrogen ions.

5. The method of claim 1, wherein the analyzer is operable to reduce proton counts by at least three orders of magnitude.

6. The method of claim 1, wherein the analyzer is operable to transmit at least 25 % of oxygen ions entering the analyzer.

7. An ion composition analyzer, for selectively reducing ion counts in an ion mixture in a plasma in space, wherein the mixture has at least a first ion type and a second ion type, the first ion type being lower in mass than the second ion type, the first ion type and the second ion type further comprising ions of an energy range, comprising:

a pair of deflection plates separated by a gap to form toroidal ion path;

an entrance to the deflection plates for receiving ions into the ion path in a 360 degree range of input angles;

a first section of the ion path operable to apply a DC-only voltage across the ion path; and a second section of the ion path operable to apply an RF voltage across the ion path;

wherein the first section and second section are adjacent, such that selected ions enter the first section, pass directly from the first section to the second section and exit the second section;

wherein the DC voltage is selected to permit only ions within a selected energy band of the energy range to pass from the first section to the second section;

wherein the RF voltage and the length of the second path are selected such that a predominant number of ions of the first ion type undergo at least one oscillation between the plates and are absorbed into the deflection plates before exiting the second section, and a predominant number of ions of the second ion type are allowed to exit the second section.

8. The method of claim 1, wherein the energy range is from several eV to more than 20 eV.

* * * * *